United States Patent [19]

Smith et al.

[11] Patent Number: 4,808,459

[45] Date of Patent: Feb. 28, 1989

[54] CARPET WITH POLYVINYLIDENE CHLORIDE LATEX TUFT-LOCK ADHESIVE COATING

[75] Inventors: Vernon C. Smith, Huntersville; Ruth C. Roberts, Salisbury, both of N.C.

[73] Assignee: Collins & Aikman Corporation, New York, N.Y.

[21] Appl. No.: 97,604

[22] Filed: Sep. 16, 1987

[51] Int. Cl.[4] ..... B32B 27/30

[52] U.S. Cl. ..... 428/95; 156/72; 428/96; 428/97

[58] Field of Search ..... 428/95, 96, 97; 156/72

[56] References Cited

U.S. PATENT DOCUMENTS

| | | | |
|---|---|---|---|
| Re. 31,826 | 2/1985 | Machell | 428/92 |
| 2,950,221 | 8/1960 | Bauer et al. | 156/72 |
| 3,390,035 | 6/1968 | Sands | 156/72 |
| 3,525,662 | 8/1970 | Padgett et al. | 156/72 |
| 3,537,946 | 11/1970 | Truax et al. | 156/72 |
| 3,668,041 | 6/1972 | Lonning | 156/309 |
| 3,676,280 | 7/1972 | Sands | 428/95 |
| 3,695,987 | 10/1972 | Wisotzky et al. | 428/95 |
| 3,975,356 | 8/1976 | Dickens, Jr. | 260/45.75 |
| 4,012,546 | 3/1977 | Schwartz et al. | 428/95 |
| 4,097,630 | 6/1978 | Schwartz et al. | 428/95 |
| 4,101,700 | 7/1978 | Ray, Jr. et al. | 428/131 |
| 4,109,039 | 8/1978 | McCoy | 428/95 |
| 4,143,030 | 3/1979 | Hartitz | 260/45.75 B |
| 4,151,149 | 4/1979 | Smith | 156/306 |
| 4,225,376 | 9/1980 | Berg | 156/272 |
| 4,333,786 | 6/1982 | Civardi et al. | 428/296 |
| 4,595,617 | 6/1986 | Bogdany | 428/95 |

FOREIGN PATENT DOCUMENTS 971958 10/1964 United Kingdom .

*Primary Examiner*—Marion C. McCamish

*Attorney, Agent, or Firm*—Bell, Seltzer, Park & Gibson

[57] ABSTRACT

A pile carpet having a primary backing with pile yarns extending from the primary backing is provided with a tuft-lock coating comprising a copolymer of vinylidene chloride with at least one acrylic monomer, and having a glass transition temperature of 0° C. or less. The coating imparts excellent tuft-lock properties to the carpet and also serves as a thermoplastic adhesive layer for laminating the carpet to a secondary backing.

15 Claims, 1 Drawing Sheet

CARPET WITH POLYVINYLIDENE CHLORIDE LATEX TUFT-LOCK ADHESIVE COATING

FIELD AND BACKGROUND OF THE INVENTION

This invention relates to a carpet and its method of preparation. More particularly, this invention relates to the use of a coating of a polyvinylidene chloride copolymer latex composition to both secure the yarns of the carpet to the backing and to function as an adhesive layer for bonding the carpet to a secondary backing while providing enhanced flame and smoke retardant properties to the carpet.

Most conventional carpets comprise a primary backing with yarn tufts in the form of cut or uncut loops extending upwardly from the backing and forming a pile surface. In tufted carpets, the yarn is inserted into the backing by tufting needles, and to maintain the yarn tufts permanently in place in the backing, an adhesive coating is applied to the rear surface of the primary backing. This coating is typically referred to as a "tuft-lock" coating.

It is fairly common, for example, to apply a latex of a resin such as polyvinyl chloride to the rear of the carpet and to heat the carpet to dry the latex and thereby adhesively bind the pile yarns in the carpet. Exemplary latex tuft-lock coating layers are disclosed in U.S. Pat. No. 3,695,987 to Wistozky et al and U.S. Pat. No. 4,109,039 to McCoy.

The carpet also typially includes a secondary backing bonded to the primary backing. The secondary backing provides extra padding to the carpet, absorbs noise, adds dimensional stability and often functions as a heat insulator. The secondary backing typically either a woven fabric such as jute or a foam sheet, is laminated to the primary backing by an adhesive layer applied to the tuft-lock coated primary backing.

As an alternative to the use of latex tuft-lock coatings, which require a separate drying step, thermoplastic tuft-lock adhesives have been developed which can be applied as a hot melt. Exemplary hot melt adhesive tuft-lock coatings are disclosed in U.S. Pat. Nos. 3,390,035 and 3,676,280 to Sands, U.S. Pat. No. 3,537,946 to Truax et al and No. Re. 31,826 to Machell. However, the practicality of using such hot melt adhesives is restricted by the requirement of expensive and specialized hot melt extruders which are not available in many carpet mills. British Pat. No. 971,958 to Dow Chemical Company discloses using a hot melt thermoplastic olefin polymer as a tuft-lock coating and as an adhesive for simultaneously laminating a secondary backing to the primary backing. However, the same problems and limitations noted above for hot melt coatings still apply.

The polyvinylidene chloride copolymer latex composition of the present invention is advantageously applied to the rear of the primary backing of the carpet and is dried in the conventional manner for application of latex coatings using conventional equipment which is readily available in most carpet mills. The coating provides excellent tuft-lock properties, and in addition, the dried latex coating has excellent thermoplastic adhesive properties which can be activated in a subsequent heating step for bonding the primary backing to a secondary backing. Thus, the present invention eliminates the necessity of first applying a tuft-lock coating and then applying a different adhesive coating to bind the secondary backing, which adds cost and time to making the carpet.

SUMMARY OF THE INVENTION

The pile carpet of the present invention includes a primary backing and pile yarns extending from the primary backing to form pile tufts. A tuft-lock coating comprising polyvinylidene chloride copolymer latex composition having activatable thermoplastic adhesive properties is used to secure the pile yarns to the backing and, on subsequent activation, the coating also serves to adhesively bond the carpet to a secondary backing. In addition to having excellent tuft bonding characteristics and excellent resistance to delamination of the secondary backing, the polyvinylidene chloride copolymer latex imparts good flame retardancy and low smoke propertis to the carpet. In addition, the tuft-lock adhesive coating can be loaded to a high degree with a filler, such as aluminum trihydrate, which enhances the flame retardancy and low smoke properties of the carpet without adversely affecting the adhesive properties of the coating. For example, the coating may comprise from about 30 to 60 percent by weight of a polyvinylidene chloride copolymer latex composition and from about 70 to 40 percent by weight aluminum trihydrate filler.

The present invention also provides a method of preparing a pile or tufted carpet which includes the steps of applying the latex coating to the rear of the primary backing, heating the latex coating to dry it and to thereby lock the pile yarns in place, and thereafter, heating the dried coating to activate the thermoplastic adhesive properties of the dried coating and securing a secondary backing to the primary backing utilizing the thermoplastic adhesive properties of the coating.

BRIEF DESCRIPTION OF THE DRAWINGS

Some of the features and advantages of the invention having been stated, others will become apparent from the detailed description which follows, and from the accompanying drawings, in which.

DETAILED DESCRIPTION OF THE INVENTION

The present invention now will be described more fully hereinafter with reference to the accompanying drawings, in which preferred embodiments of the invention are shown. This invention can, however, be embodied in many different forms and should not be construed as limited to the embodiments set forth herein; rather, applicant provides these embodiments so that this disclosure will be thorough and complete, and will fully convey the scope of the invention to those skilled in the art.

Figure 2:
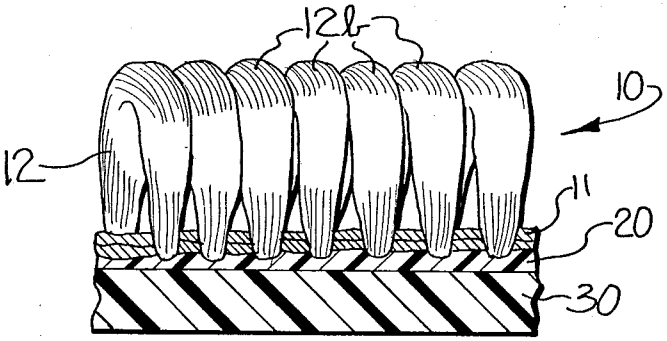
FIG. 2 is an enlarged cross-sectional view of a portion of a loop pile carpet according to the present invention.
Figure 1:
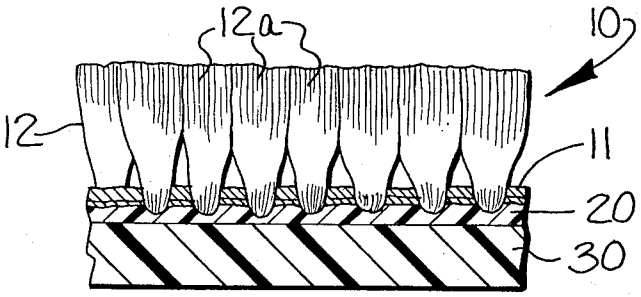
FIG. 1 is an enlarged cross-sectional view of a portion of a cut pile carpet in accordance with the present invention.

As illustrated in FIGS. 1 and 2, the carpet of the present invention has three basic components, namely a carpet layer 10, a tuft-lock adhesive coating layer 20 and a secondary backing 30. The carpet layer 10 may be of any suitable construction, such as woven, non-woven or tufted. In the embodiment illustrated, the carpet 10 is of a tufted construction and includes a primary backing 11 and pile yarns 12 extending from the backing. The primary backing may be formed of natural fibers, such as jute, or of synthetic fibers such as polypropylene, polyethylene or polyester, for example. The pile yarns may be cut to form cut pile tufts 12*a* as shown in FIG. 1 or may form loops 12*b* as shown in FIG. 2.

The tuft-lock adhesive coating 20 is a polyvinylidene chloride copolymer latex composition having thermoplastic adhesive properties, and is carried by the rear surface of the primary backing 11 of the carpet. The physical properties of the polyvinylidene copolymer are highly important to successful utilization as a carpet backing coating for the present invention. In this regard, there are a number of important requirements which must be met by such a coating. It must be capable of being applied to the carpet and dried using the processes and equipment conventionally employed in the carpet industry for latex coating. It must provide excellent adhesion to the pile tufts to secure them firmly to the backing. It must have thermoplastic adhesive properties which can be activated by subsequent heating of the dried coating, and upon such heating the coating must remain sufficiently viscous to remain in place on the primary backing without loss of the tuft-bonding properties or undesired wicking onto the pile tufts. The coating must also have a relatively high halogen content to ensure good smoke and flame retardant properties, and must accept a high loading with fillers such as aluminum trihydrate. Furthermore, the coating must maintain sufficient softness and flexibility, even with high filler loading or at low temperature, to enable the carpet to be easily rolled and unrolled during installation. The softness and flexibility properties are also important in ensuring that the carpet will lie flat and will not take a permanent set.

In accordance with the present invention, it has been found that the foregoing requirements are achieved by using a copolymer of vinylidene chloride with at least one acrylic monomer, and wherein the proportions of vinylidene chloride monomer and acrylic monomer or monomers are selected so that the copolymer has a glass transition temperature of 0° C. or less, and the copolymer has thermoplastic adhesive properties.

Polymers of vinylidene chloride are known to possess good smoke and flame retardant properties. However, homopolymers of vinylidene chloride monomer are stiff, brittle and are difficult to form a film due to the highly crystalline nature of the polymer. Smoke retardant copolymers of vinylidene chloride with monomers such as vinyl chloride have been disclosed for example in U.S. Pat. Nos. 3,975,356; 4,012,546; 4,097,630 and 4,143,030 and have been proposed for use in carpets. However, such compositions do not possess the aforementioned characteristics which are required by the tuft-lock coating composition of the present invention.

The term acrylic monomer as used herein refers to acrylic acid, methacrylic acid, esters of these acids, or acrylonitrile. These monomers, when copolymerized with vinylidene chloride monomer, will soften the copolymer, imparting a relatively low glass transition temperature ($T_g$), of preferably less than 0° C. Exemplary monomers include alkyl esters of acrylic acid with an alkyl group having from 1 to 18 carbon atoms, including methyl, ethyl, n-butyl, sec-butyl, the various isomeric pentyl, hexyl, heptyl, and octyl (especially 2-ethylhexyl), lauryl, cetyl, stearyl and like groups; and alkyl esters of methacrylic acid with an alkyl group having from 4 to about 18 carbon atoms, including n-butyl, n-hexyl, 2-ethylhexyl, n-octyl, lauryl, cetyl, stearyl and like groups.

These acrylic monomers are present in amounts, depending upon the particular acrylic monomer or monomers employed, sufficient to impart the desired softness, flexibility and film-forming properties to the coating. Desirably, the copolymer should have a glass transition temperature ($T_g$) of about 0° C. or lower, and particularly preferred are copolymers having a $T_g$ of about −10° C. The acrylic softening monomers and the amounts required to obtain the desired $T_g$ can be determined experimentally or by use of known methods or tables.

One particularly suitable composition is an emulsion copolymer formed from vinylidene chloride as the primary monomer and 2-ethylhexyl acrylate as the softening monomer, and having a $T_g$ of about −10° C. This copolymer is capable of being applied by conventional latex coating techniques, and when dried, forms a tough adhesive film coating with a relatively low heat seal temperature on the order of about 110° F. This class of polymer composition has been developed for use mainly in the packaging and laminating fields as a solvent-free heat sealable barrier layer on packaging films such as those packages used to contain potato chips and the like. Applicant has discovered that this class of polmer has properties which make it especially suitable and advantageous as a tuft-lock adhesive coating for carpets. The copolymer has low smoke and flammability properties and will accept relatively high loading with fillers such as clay, calcium carbonate, aluminum trihydrate, etc.

The ability to load the coating with high amounts of fillers such as aluminum trihydrate permits an increase in the superior flame retardancy and low smoke properties the copolymer already has. Preferred coating compositions in accordance with the present invention are loaded with filler to yield a composition ranging from about 30 to 60 percent by weight vinylidene chloride copolymer and about 70 to 40 percent by weight filler. In addition to the fillers, the coating may include other conventional additives, thickeners, plasticizers and the like. The polyvinylidene copolymer coating may in some applications, be blended with other resins, such as SBR resins.

The coating is easier to apply to the carpet than hot melt thermoplastic adhesives which require expensive and complex machines and processes to apply the coating, and the coating also penetrates the fibers of the carpet yarns to yield better adhesion. Additionally, the coating exhibits particularly excellent tuft-pull properties. The term "tuft-pull" refers to the ability of a tuft-lock coating to lock and secure the pile yarn tufts to the primary backing and is determined by measuring the amount of force required to physically pull a tuft free from the primary backing. Suitable tuft-pull properties can be achieved by applying an amount of coating ranging from about 12 ounces per square yard to about 32 ounces per square yard (dry basis), which results in a carpet having a tuft-pull value of at least 10 pounds force, and in many instances a tuft-pull value of 15 pounds force or greater. This coating amount is significantly less than the amount of hot melt adhesive required to achieve the comparable tuft-pull values. The polyvinylidene copolymer also functions as an excellent adhesive to provide a very strong bond to the secondary backing or to other substrates.

The secondary backing 30 may be formed of woven or non-woven materials similar to those used as the primary backing. Thus for example, the secondary backing may be formed of natural fibers, such as jute, or of synthetic fibers such as polypropylene, polyethylene or polyester. Such a secondary backing provides dimensional stability to the carpet. The secondary backing may also be formed of a foam polymer or copolymer. Suitable foam compositions include urethane polymers, polymers and copolymers of ethylene, propylene, isobutylene, and vinyl chloride. When a foam secondary backing is used, it may be prefoamed and then laminated onto the primary backing, or the composition may contain a thermally activatable blowing agent and may be foamed immediately prior to lamination or after lamination. Additionally, the secondary backing may exhibit thermoplastic adhesive properties of its own, and the seconary backing can be preheated prior to lamination to render the surface thereof adhesive.

Figure 3:
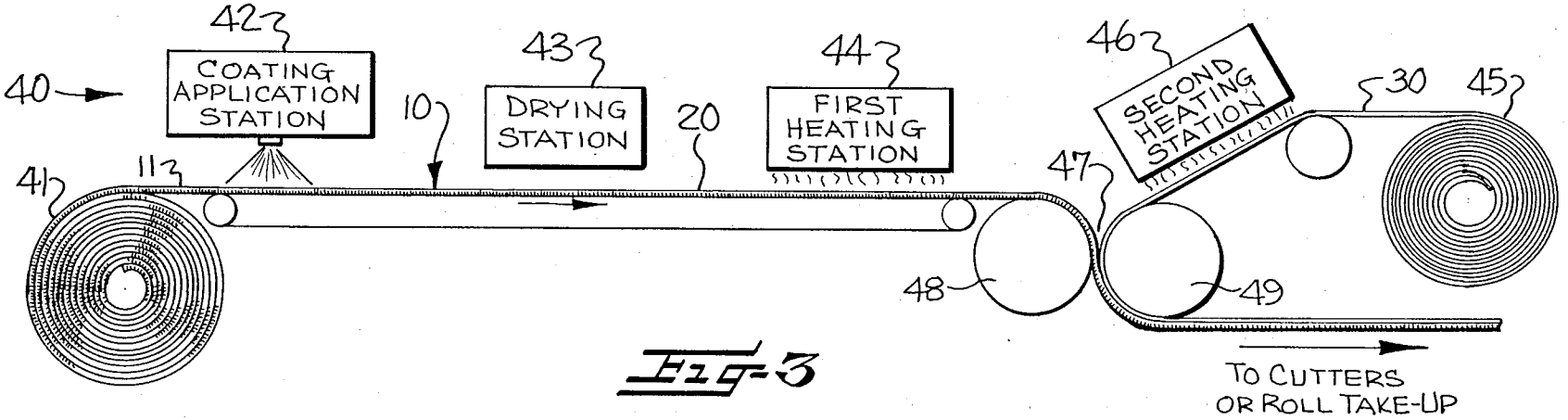
FIG. 3 is a diagramatic and schematic representation of a method of producing carpet according to the present invention.

Referring now to FIG. 3, a basic carpet production line system is generally indicated by the reference numeral 40. Carpet 10 is conveyed from a carpet source, such as a roll 41 to a coating application station 42 where the polyvinylidene latex tuft-lock adhesive coating is applied to the backing 11 of the carpet. The carpet is then advanced to a drying station 43 where heat is applied to dry the latex and thereby secure the pile yarns to the primary backing 11. At this point, the carpet can be wound into a roll and shipped or stored. In a subsequent operation the secondary backing can be laminated to the carpet after reheating the polyvinylidene copolymer coating to activate its adhesive properties. Alternatively, as in the embodiment illustrated, the carpet may be advanced directly to a first heating station 44 where heat is applied to the carpet backing and the dried tuft-lock coating is heated to a temperature at which the coating exhibits thermoplastic adhesive properties. The carpet backing is then advanced to a bonding station 47 defined by a nip between two rolls 48, 49 where the secondary backing 30 is laminated to the carpet backing. The secondary backing 30 is advanced from a suitable supply source, such as roll 45. A secondary heating station 46 is utilized to optionally preheat the surface of the secondary backing 30 to promote better bonding. When the secondary backing is a thermoplastic foam, the second heating station can be utilized to activate the thermoplastic properties of the secondary backing. The thus formed carpet is then taken up in roll form or cut into squares (tiles) in final preparation for end use.

The method of preparing carpet having the coating and utilizing such a carpet production line system is best illustrated in the specific example which follows.

EXAMPLE

A latex emulsion was prepared of a commercially available copolymer of polyvinylidene and 2-ethylhexyl acrylate ($T_g$ of $-10°$ C.) by slowly adding to a mix tank, with agitation, the following:

| | Parts by Weight |
|---|---|
| PVDC-acrylate copolymer (47% solids) | 51.3 |
| Defoamer | .13 |
| Antifoam Surfactant (Ethylene oxide-propylene oxide block copolymer) | .33 |

-continued

| | Parts by Weight |
|---|---|
| Ammonia 28% | .13 |

The pH of the mix tested and adjusted to between 8.5 and 9.5 by addition of ammonia. Then 45.5 parts by weight aluminum trihydrate was slowly added with mixing and mixing was continued for 20 minutes. Then up to about 2.5 parts by weight of a sodium polyacrylate thickener was added to adjust the viscosity of the mix to between 5000 to 5500 cps. The resulting mix had a total solids content of 59 to 60 percent, a pH within the range of 8.5 to 10 and a viscosity at 20 rpm of between 5000 to 6000 cps.

A carpet was prepared on a commercially available tufting machine, and the yarns were tufted into a polypropylene woven primary backing to form a carpet. After tufting, the carpet was conveyed to a coating application station where the above polyvinylidene chloride latex emulsion coating was applied to the rear of the primary backing at a rate of about 18–24 ounces per square yard. The coating was then dried at the drying station at a temperature of 280° F. for about 7 minutes, after which the carpet was allowed to cool and was formed into a roll. In a subsequent operation, the carpet was unrolled and the latex-coated rear surface of the primary backing was heated under infrared heat lamps to a temperature of from 350° to 400° F. to activate the thermoplastic adhesive properties of the coating. An ethylene vinyl acetate foam sheet (34 ounces per square yard) was brought into contact with the heated carpet and laminated thereto by the polyvinylidene adhesive coating.

A series of experiments was performed on a sample of the carpet prepared as above and on a sample prepared utilizing a styrene butadiene rubber (SBR) tuft-lock coating for comparison since SBR is often used in the carpet industry as a tuft-lock coating. These tests particularly included measurements of the flame and smoke retardancy properties and the adhesion properties of the coated carpets. Flame retardancy was measured using the ASTM E-648 test which measures the critical radiant flux of horizontally mounted floor covering systems exposed to a flaming ignition source in a radiant heat energy environment. This test is intended to simulate fire exposure of the carpet to fires that may develop in corridors and exitways of buildings. Smoke retardancy was measured using the ASTM-662 test which determines the amount of the attenuation of a light beam by smoke accumulating within a closed chamber due to pyrolytic decomposition and flaming combustion.

Tuft bind was measured using the ASTM D-1335 test which determines the amount of force required to pull a tuft completely out of a cut pile or the force required to pull one of the legs of a loop free from the backing. Delamination was measured utilizing the ASTM D-3936 test which determines the delamination strength of the secondary backing adhered to the primary backing. The results are summarized in Table I.

| Test | PVDC Coating (The Invention) | SBR Coating (Control) |
|---|---|---|
| Tuft Bind | 10.9 | 7.3 |
| Delamination | Cannot | <1.0 |
| Radiant Panel | 1.00 | 0.43 |

-continued

| Test | PVDC Coating (The Invention) | SBR Coating (Control) |
|---|---|---|
| Smoke Density | 157 | 144 |

As is readily apparent, carpet produced utilizing a polyvinylidene chloride latex emulsion coating results in a product having superior adhesion properties as demonstrated by the tuft bind and delamination tests. Additionally, such a carpet has improved flame retardancy properties in that a value of 0.45 is an acceptable value for commercial use, and 1.00 is significantly higher than this or the value obtained for the SBR coating. The smoke density value is comparable to the value for the SBR coating.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A pile carpet comprising:

a primary backing, pile yarns extending from the front of said primary backing to form pile tufts, and having portions extending through the primary backing to the rear thereof, and a tuft-lock coating carried by the rear of said primary backing and securing said pile yarns to said primary backing, said tuft-lock coating comprising a copolymer of vinylidene chloride with at least one acrylic monomer, said copolymer having a glass transition temperature of 0° C. or less, and said coating having thermoplastic adhesive properties capable of subsequent activation for bonding of the carpet to a secondary backing.

2. A pile carpet according to claim 1 wherein said tuft-lock coating includes a filler.

3. A pile carpet according to claim 2 wherein said filler is aluminum trihydrate and serves to impart enhanced flame and smoke retardant properties to the tuft-lock coating.

4. A pile carpet according to claim 2 wherein the tuft-lock coating comprises, on a solid basis, from about 30 percent to 60 percent by weight vinylidene chloride copolymer and from about 70 to 40 percent by weight filler.

5. A pile carpet according to claim 1 wherein the vinylidene chloride copolymer is a copolymer of vinylidene chloride and an alkyl acrylate.

6. A pile carpet according to claim 1 wherein the vinylidene chloride copolymer is a copolymer of vinylidene chloride and 2-ethylhexyl acrylate and has a glass transition temperature of about −10° C.

7. A pile carpet according to claim 1 additionally comprising a secondary backing adhesively secured to said primary backing by the thermoplastic adhesive properties of said tuft-lock coating.

8. A pile carpet according to claim 7 wherein said secondary backing is a foam sheet.

9. A pile carpet according to claim 8 wherein said foam comprises an ethylene vinylacetate copolymer.

10. A pile carpet comprising:

a primary backing formed of a woven or nonwoven fabric, pile yarns extending from the front of said primary backing to form pile tufts, and having portions extending through the primary backing to the rear thereof, and a tuft-lock coating carried by the rear of said primary backing and securing said pile yarns to said primary backing, said coating having thermoplastic adhesive properties capable of subsequent activation for bonding of the carpet to a secondary backing and having improved flame and smoke retardant properties, and comprising a copolymer of vinylidene chloride with an alkyl acrylate monomer, said copolymer having a glass transition temperature of 0° C. or less, and dispersed in said copolymer an aluminum trihydrate filler in an amount of from about 40 to 70 percent by weight so as to further improve the flame and smoke retardant properties of the coating.

11. A pile carpet according to claim 10 additionally comprising an ethylene vinyl acetate foam secondary backing adhesively secured to said primary backing by the thermoplastic adhesive properties of said tuft-lock coating.

12. A method of preparing a pile carpet comprising:

(a) applying to the rear surface of the primary backing of a carpet and in contact with pile yarn extending through the rear surface of the backing, a tuft-lock coating comprising a copolymer of vinylidene chloride with at least one acrylic monomer, said copolymer having a glass transition temperature of 0° C. or less, and said coating having activatable thermoplastic adhesive properties capable of subsequent activation;

(b) heating the rear surface of the primary backing to dry the latex coating composition and to secure the pile yarns to the primary backing;

(c) thereafter heating the dried latex coating to activate the thermoplastic adhesive properties thereof; and (d) bonding a secondary backing to the primary backing utilizing the thermoplastic adhesive properties of the latex coating.

13. The method of claim 12 wherein the secondary backing also has activatable thermoplastic adhesive properites, and including the additional step of preheating the secondary backing prior to said step of securing the secondary backing to the primary backing so as to activate the thermoplastic adhesive properties of the secondary backing.

14. The method of claim 12 wherein the amount of coating applied ranges from about 12 ounces per square yard to about 32 ounces per square yard.

15. The method of claim 14 wherein said vinylidene chloride copolymer is a copolymer of vinylidene chloride and 2-ethylhexyl acrylate.

* * * * *

UNITED STATES PATENT AND TRADEMARK OFFICE

CERTIFICATE OF CORRECTION

PATENT NO. : 4,808,459

DATED : February 28, 1989

INVENTOR(S) : Vernon C. Smith, et al.

It is certified that error appears in the above-identified patent and that said Letters Patent is hereby corrected as shown below:

Column 1, line 31, "typially" should be -- typically --.

Column 2, line 17, "propertis" should be -- properties --.

Column 8, line 33, "yarn" should be -- yarns --.

Signed and Sealed this

Seventeenth Day of October, 1989

*Attest:*

DONALD J. QUIGG

*Attesting Officer*

*Commissioner of Patents and Trademarks*